US005657580A

United States Patent [19]

Kobrehel

[11] Patent Number: 5,657,580

[45] Date of Patent: Aug. 19, 1997

[54] WINDOW REGULATOR WITH SPRING ACTUATED DIRECT CABLE TENSIONING

[75] Inventor: Michael David Kobrehel, Eckhart, Ind.

[73] Assignee: Excel Industries, Inc., Elkhart, Ind.

[21] Appl. No.: 536,127

[22] Filed: Sep. 29, 1995

[51] Int. Cl.[6] ..... E05F 11/48; E05F 11/00

[52] U.S. Cl. ..... 49/352; 49/360

[58] Field of Search ..... 49/227, 348, 352, 49/360

[56] References Cited

U.S. PATENT DOCUMENTS

| | | | |
|---|---|---|---|
| 3,444,649 | 5/1969 | Rivolier . | |
| 4,090,329 | 5/1978 | Rampel . | |
| 4,235,046 | 11/1980 | Hess . | |
| 4,403,450 | 9/1983 | Ishii | 49/352 |
| 4,984,386 | 1/1991 | Marscholl . | |
| 5,074,077 | 12/1991 | Toyoshima . | |
| 5,505,022 | 4/1996 | Shibata et al. | 49/352 |

FOREIGN PATENT DOCUMENTS

| | | | |
|---|---|---|---|
| 0164114 | 12/1985 | European Pat. Off. | 49/352 |
| 2750904 | 5/1979 | Germany | 49/352 |

*Primary Examiner*—Kenneth J. Dorner
*Assistant Examiner*—Curtis Cohen
*Attorney, Agent, or Firm*—Banner & Witcoff, Ltd.

[57] ABSTRACT

A window regulator employs a drive cable to regulate opening and closing of a window in a vehicle. The drive cable is attached to a glider which is attached to the window, and extends around a first and second guide means and a drive drum. Rotation of the drive drum causes movement of the cable which in turn causes movement of the window. One of the guide means is slidably mounted and coupled to a spring which causes the guide means to apply tension to the drive cable. The spring is positioned along substantially the same axis along which the slidably mounted guide means may travel.

28 Claims, 6 Drawing Sheets

WINDOW REGULATOR WITH SPRING ACTUATED DIRECT CABLE TENSIONING

FIELD OF THE INVENTION

The present invention is directed to a motor vehicle window regulator assembly. More particularly, the present invention is directed to a regulator assembly having a cable and drum sub-assembly for opening and closing a windowpane in a motor vehicle window opening.

BACKGROUND

Window regulators, which operate to open and close a moveably mounted window in a motor vehicle window opening, take a variety of forms including cable regulators which employ cables actuated by a drive means, such as a hand crank or electric motor. In cable regulators a cable drive drum causes movement of the cable upon rotation of the drive drum by the drive means. The cable is generally attached in some form to the window and is guided by pulleys, conduits and other types of guide means to cause movement of the window upon rotation of the drive drum.

Maintaining tension on the cable in a cable operated window regulator is important to the proper operation of the regulator. A loose cable may slip from any of the guides, causing failure of the system. In addition, a loose cable will also cause increased stress on the cable and other portions of the system by resulting in uneven motion of the cable when movement of the window is initiated or when the direction of movement of the window is suddenly reversed.

A known approach to maintaining tension on the cable includes the application of a tensioning force to a conduit which encloses the cable. The tensioning force is typically applied by a spring against the conduit and indirectly causes tension in the cable by increasing the travel length of the cable. Unfortunately, the indirect tensioning of the cable by the aforesaid approach can cause increased wear on the conduit. In addition, the spring actuated mechanisms which act upon the conduit often substantially increase the complexity of the regulator, thus increasing the fixed cost of the regulator in addition to increasing the manufacturing complexity.

U.S. Pat. No. 5,074,077 entitled Window Regulator to Toyoshima et al. discloses a cable tensioning device which applies a tensioning force directly to the cable. In Toyoshima, a cable guide 10 is shown with a spring 21 which applies a downward force on the cable guide to reduce tension in the drive cable 39. Guide opening 14 and guide pin 20 hold the cable guide in place and determine the direction of travel of the cable guide.

While the cable guide disclosed in Toyoshima overcomes some of the above noted shortcomings of devices which apply tension to the cable indirectly through the conduit, it appears to have several shortcomings. Most notably, the positioning of spring 21 hinders the proper movement of the cable guide 10.

A spring can only transmit forces along a single axis. Consequently, if the spring is not on the same axis as the guide pin, as in Toyoshima, torsional loading is created which can inhibit proper movement of the cable guide. Increasing the amount of space between guide opening 14 and guide pin 20 can increase movement of the cable guide, but also may increase rattling, noise and wear as the cable guide moves laterally against the guide pin. There is accordingly, a need for a window regulator assembly which overcomes the deficiencies noted above.

It is an object of the present invention to provide a window regulator assembly which maintains adequate tension on a drive cable in the assembly used to obtain movement of the window, while reducing the attendant complexity, cost and component wear introduced by systems as described above. This object, and other objects of the invention will be apparent from the following disclosure and detailed description of certain preferred embodiments.

SUMMARY

In accordance with a first aspect, a window regulator assembly, for regulating the opening and closing of a vehicle window, which is slidably mounted in a motor vehicle body window aperture includes a first glider which is attached to the windowpane and which is slidably mounted to an elongated first track. A cable is attached to the first glider and a first cable guide means is attached to a first position on the first track. A second cable guide means is slidably coupled to a second position on the first track. The cable travels along a first axis between the first cable guide means and the second cable guide means to move the glider along the first track. The cable is moved along the first axis by rotation of a rotatable cable drive means. A first spring is positioned substantially along the first axis and is coupled at a first position on the first spring to the second cable guide means and at a second position on the first spring to the first track. The first spring exerts a force on the second cable guide means to force the second cable guide means in a direction along the first track, away from the first cable guide means.

Embodiments utilizing the principles of the invention described herein offer significant advantages over the systems described above. The slidably coupled pulley plate maintains appropriate tension on the cable in a manner which is cost effective and simple to assemble. Moreover, positioning of the spring along the axis traveled by the cable between the first and second cable guide means reduces the torsional loading caused by positioning of the spring along an axis different from the axis of movement of the second pulley.

In a further aspect of the invention, the first and second guide means take the form of pulleys which rotate to minimize friction as the cable is moved. The principles of the present invention also include the use of additional tracks and guide means to support larger windows.

Additional features and advantages of various preferred embodiments will be better understood from the following detailed discussion.

BRIEF DESCRIPTION OF THE DRAWINGS

Certain preferred embodiments of the invention are discussed below with reference to the appended drawings wherein.

Figure 1:
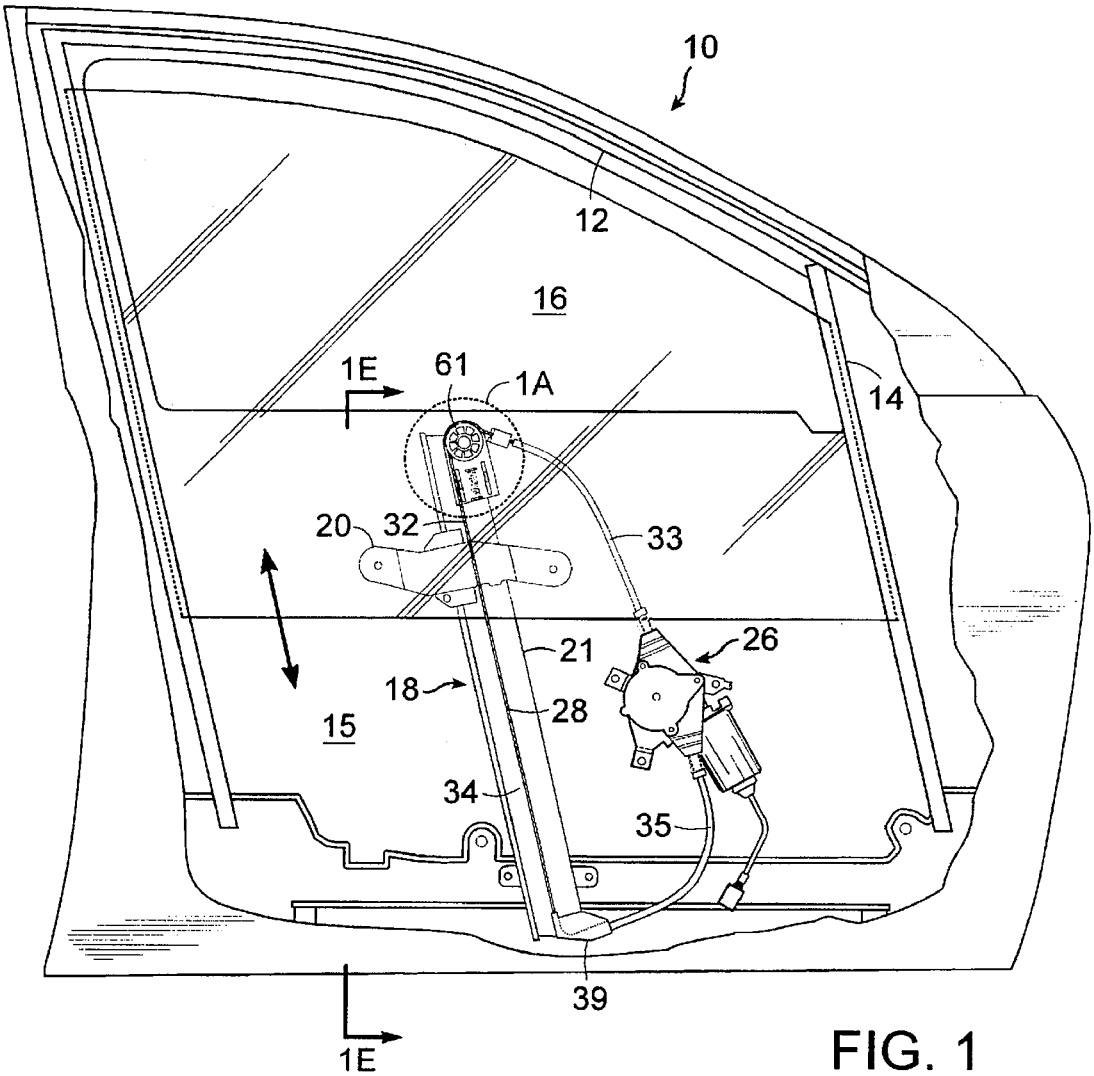
FIG. 1 schematic partially cut away outside view of a motor vehicle door defining a window opening in which is mounted a vertically slidable windowpane having a regulator assembly comprising a cable and drum subassembly in accordance with a first preferred embodiment.

The figures referred to above are not drawn necessarily to scale and should be understood to present a simplified representation of the invention, illustrative of the basic principles involved. Window assemblies incorporating the novel cable and drum drive assemblies will have configurations and components determined, in part, by the intended application and use environment. Some features of the window assembly depicted in the accompanying figures have been enlarged or distorted relative to others to facilitate visualization and understanding. In particular, thin features may be thickened and long features may be shortened. References to direction and position, unless otherwise indicated, refer to the orientation of the window assembly illustrated in the drawings.

DETAILED DESCRIPTION OF CERTAIN PREFERRED EMBODIMENTS

In view of the above disclosure, those who are skilled in this area of technology will recognize that the novel window regulator assemblies as heretofore described can be used for operating motor vehicle windows which are movably mounted in a variety of different ways. They are applicable, for example, to horizontally slidable windows as well as vertically slidable windows. The following discussion of certain preferred embodiments focuses on window assemblies wherein the windowpanes are opened and closed by a vertical sliding action, but the design and operating principles are applicable generally to motor vehicle windows which have alternative open/close mechanisms. Similarly, although the discussion below focuses on a vertically sliding window in a motor vehicle door, the novel window regulator assemblies are applicable also, for example, to motor vehicle backlites, including pickup truck backlites, wherein many of the same constraints are applicable, such as space limitations, reliability requirements, etc.

Referring now to the window regulator assembly depicted in the appended drawings, FIG. 1 shows a preferred window regulator assembly 18 which operates in a pull/pull manner to open and close transparent glazing panel 16. In FIG. 1, a motor vehicle door 10 is shown schematically to define a window opening 12 fitted with a window frame 14 in accordance with known motor vehicle body designs and components. Transparent glazing panel 16, which is formed typically of glass or plastic, or a multilayer laminate of such materials, is vertically slidably mounted in window opening 12. More specifically, the peripheral edges of glazing panel 16 are received in a track formed by window frame 14 extending downwardly into the door cavity 15 below the so-called beltline of window opening 12. The window is vertically slidable between its open and closed positions by actuation of window regulator assembly 18.

Figure 1E:
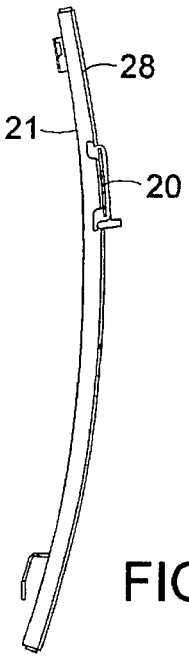
FIG. 1E is a side view of the track 21 of FIG. 1.

Window regulator assembly 18 comprises a glider 20 fitted to the lower peripheral edge of glazing panel 16 in accordance with known attachment techniques including, for example, adhesives and through-hole fasteners. Glider 20 is mounted for vertical travel on track 21, which is mounted in fixed position within door cavity 15. By traveling vertically up and down track 21, glider 20 carries glazing panel 16 upward to its closed position in window opening 12 or downward, to its open position. As seen in FIG. 1*e* track 21 is curved.

The position of glider 20 along vertical track 21 and, hence, the position of glazing panel 16 within window opening 12, is controlled by the cable and drum subassembly 26 mounted within door cavity 15. This subassembly includes cable 28 which operates in a pull/pull manner to regulate the window position. That is, cable 28 extends in a closed loop, partially within cable guide conduits 33 and 35 to pull the window upward to its closed position and to pull the window downward to its open position. Cable 28 is preferably two separate cables each of which is attached at a first end to glider 20 and at a second end to a drum (not shown)—within cable and drum subassembly 26 which functions as a drive means. Alternatively, cable 28 may be a single cable which is attached at both ends to glider 20. An up-pulling portion 32 of cable 28 extends upwardly from glider 20 to the drum subassembly 26 and acts, when driven by the drive means of the subassembly 26 discussed immediately below, to pull glazing panel 16 via bracket 20 and upwardly toward its closed position. Correspondingly, down-pulling portion 34 of cable 28 extends downwardly from glider 20 to the drum subassembly 26 to pull glazing panel 16 downwardly toward its open position.

Cable guide conduits 33 and 35 enclose cable 28 and protect the cable from abrasion and also provide guide paths for the cable. Cable guide conduit 33 is positioned between glidable guide means 61 and subassembly 26. Cable guide conduit 35 is positioned between fixed guide means 39 and subassembly 26.

In operation, cable 28 wears a path in conduits 33 and 35. The slidable pulley mechanism described in detail below advantageously compensates for any slack which occurs by cable wear including wear of conduits 33 and 35.

Figure 1A:
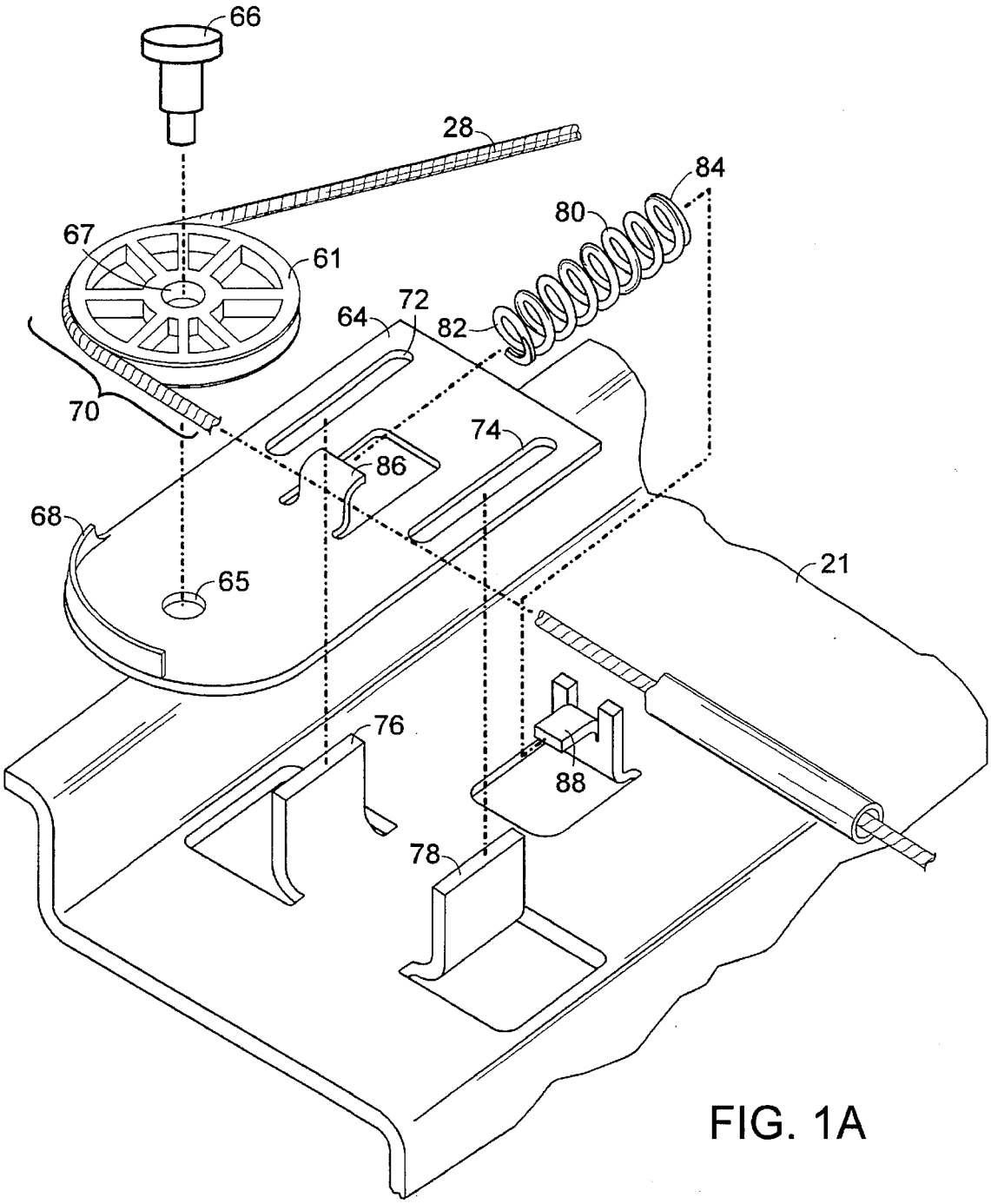
FIG. 1A is an enlarged and exploded view of the portion of FIG. 1 contained within the dotted circle designated by reference number 1A.
Figure 1B:
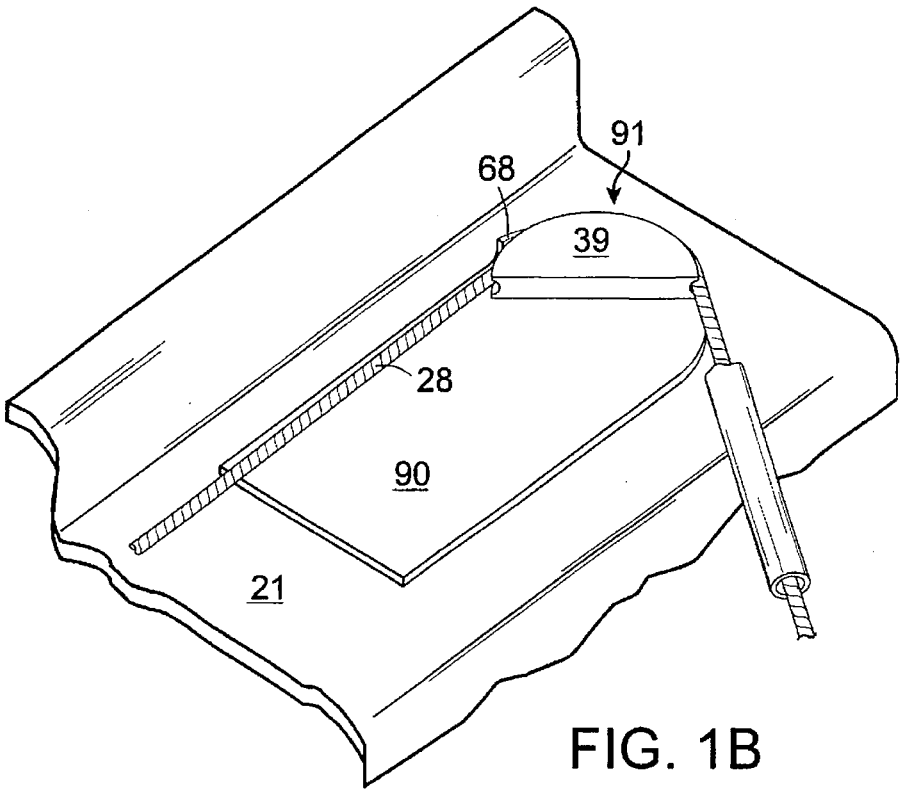
FIG. 1B is an enlarged view of the portion of FIG. 1 contained within the dotted circle designated by reference number 1B.

Cable guide means 61 preferably takes the form of a pulley and operates to reduce friction on cable 28 and guide the cable in the necessary direction. Cable guide means 39 preferably takes the form of a fixed position cable guide. As described in further detail below, cable guide means 39 and 61 operate, either singly or in tandem, to maintain tension on the cable 28. As seen in FIGS. 1, 1A and 1B, cable guide means 39 and 61 guide cable 28 along the longitudinal axis of track 21. Fixed cable guide 39 guides down pulling cable portion 34 while slidable pulley 61 guides up pulling cable portion 32. Alternatively, the positions of fixed cable guide 39 and glidable pulley 61 may be altered so that fixed cable guide 39 guides the up pulling cable portion 32 while slidable pulley 61 guides the down pulling cable portion 34. Fixed cable guide 39 is fixedly coupled to remain in a fixed rotatable position on track 21, and slidable pulley 61 is rotatably and slidably coupled to track 21 to slide over a limited distance along the length of track 21 to maintain tension in cable 28.

FIG. 1A of the drawings is an expanded and exploded view of the mounting mechanism for slidable pulley 61. Slidable pulley 61 is rotatably coupled to track 21 via a pulley plate 64. Pulley 61 is rotatably coupled to pulley plate 64 by rivet 66 which passes through a hole 67 in the center of pulley 61 and through a hole 65 in pulley plate 64. Rivet 66 is preferably formed of steel and is affixed to pulley plate 64 by conventional means. Pulley plate 64 has formed thereon a lip 68 which is shaped to be substantially concentric with an outer portion 70 along the circumference of pulley 61. Lip 68 has a height equal to approximately the thickness of pulley 61 to contain cable 28.

Pulley plate 64 is slidably mounted to track 21 by means of first and second slots 72 and 74. Tabs 76 and 78 which are integral with track 21 pass through slots 72 and 74 respectively and captivate slidable plate 64 when bent down towards track 21. The distance over which slidable plate travels is thus determined by the relative dimensions of the slots to the corresponding tabs. Pulley 61 is preferably formed of acetal or some other type of lubristic polymer. The pulley plate 64 is preferably formed of steel, but may also be formed of a suitable type of plastic.

Tension in cable 28 is maintained by means of spring 80 which preferably takes the form of a coiled compression spring which is preferably formed of steel but may alternatively be formed of plastic or other suitable material. Spring 80 is captivated at a first end 82 to pulley plate 64 by means of a tab 86 which is integral with pulley plate 64, and at a second end 84 to track 21 by means of a tab 88 which is integral with track 21. The shape of tabs 86 and 88 may be interchanged or may take another suitable shape which captivates spring 80. Tabs 86 and 88, as well as tabs 76 and 78 are formed by cutting portions of the pulley plate and track and bending the cut portions.

Fixed cable guide 39 is mounted to track 21 in a manner similar to that shown in FIG. 1A, with the exception that pulley plate 90, rather than being slidably mounted to track 21, is fixedly mounted by bolting or welding the pulley plate to the track. FIG. 1B of the drawings shows fixed pulley 61 in greater detail. As can be seen in FIG. 1B, fixed cable guide 39 and pulley plate 90 are as shown in FIG. 1A with the exception that pulley plate 90 does not have slots 72 and 74 and tab 86. Instead, as seen in FIG. 1B, pulley plate 90 is welded to track 21.

Figure 1D:
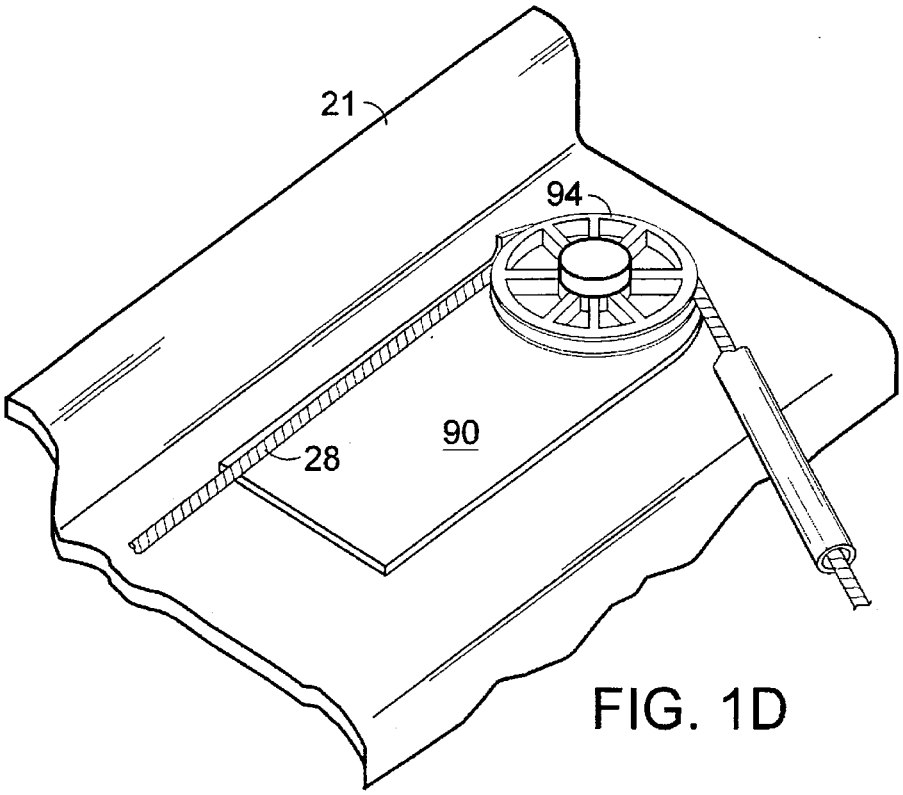
FIG. 1D is an enlarged view of an alternative embodiment to the portion of FIG. 1 shown in FIG. 1B.
Figure 1C:
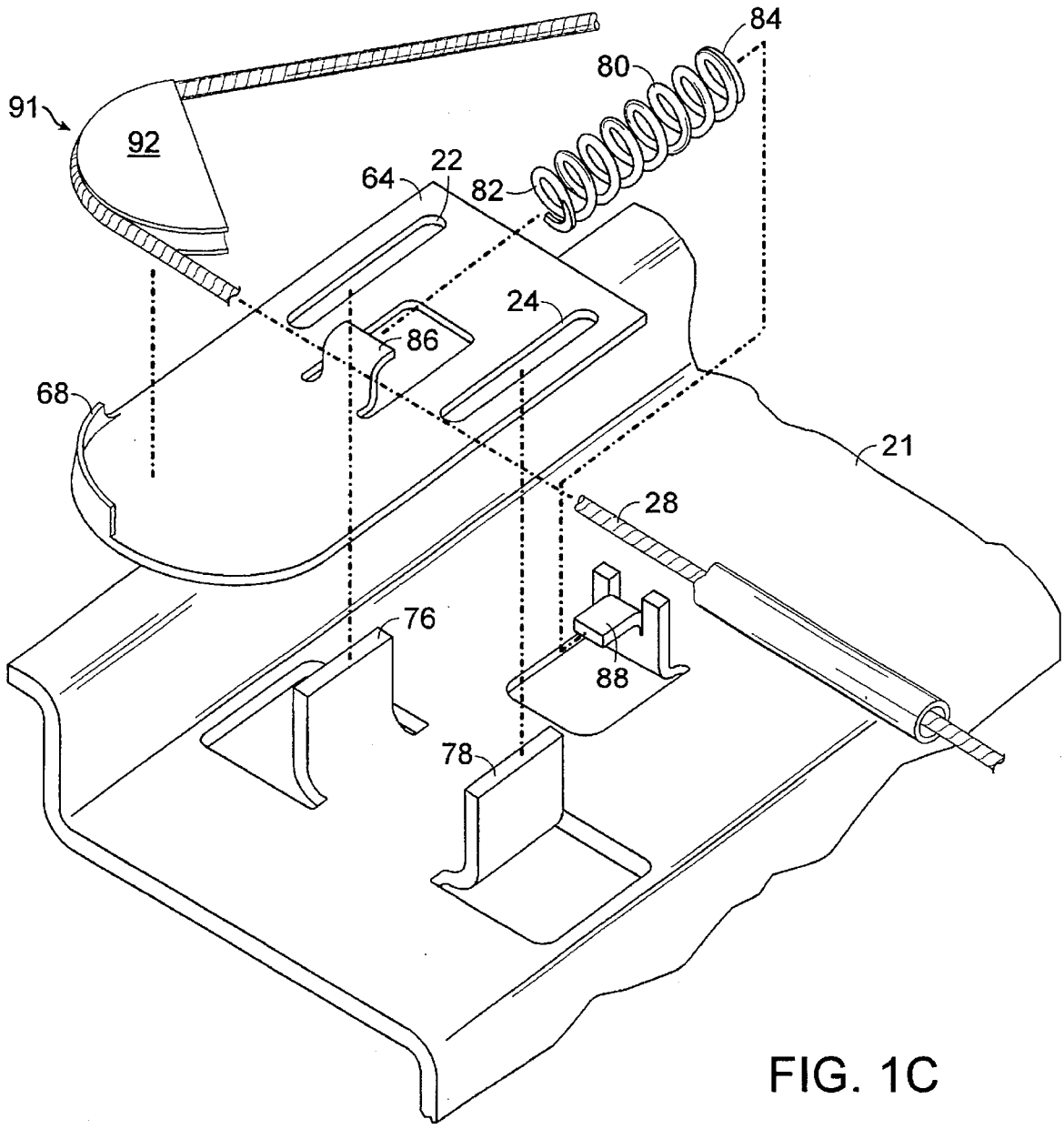
FIG. 1C is an enlarged and exploded view of an alternative embodiment to the portion FIG. 1 shown in FIG. 1A.

FIGS. 1C and 1D show alternative embodiments to the pulleys shown in FIGS. 1A and 1B. As seen in FIG. 1C, a fixed cable guide 92 replaces the pulley 61. The cable guide is channeled along the outer portion 91 to accept cable 28. Lip 68 on the pulley plate prevents the cable from escaping from the cable guide 92. As seen in FIG. 1C, the pulley plate 64 is slidably mounted to the track 21 in a manner similar to that described above for FIG. 1A. In FIG. 1D, a pulley 94 replaces fixed cable guide 39. The pulley 39 is mounted to pulley plate in a manner similar to that described for pulley 61 and pulley plate 64. The pulley plate 90 is mounted in a fixed position to track 21 in a manner similar to that described above for FIG. 1B.

Cable 28 is driven either manually by means of a hand crank coupled to drum subassembly 26, or (as seen in FIG. 1) electrically by means of an electric motor contained within cable and subassembly 26. Cable 28 preferably takes the form of two cables each of which have a first end connected to glider 20 and a second end connected to a drum contained within cable and subassembly 26. Rotation of the drum in a clockwise or counterclockwise direction causes movement of the cable. Alternatively, cable 28 may be a single piece of cable which is connected at both ends to glider 20 and is wound in multiple wraps around the drum.

Numerous suitable cable materials are available for drive cable 28 including, for example, twisted, multi-filament steel cable. For regulator assemblies employing drive means comprising an electric motor, drive cable 28 more preferably is higher tensile strength braided steel cable. It will be well within the ability of those skilled in this area of technology to select suitable, commercially available material for drive cable 28.

Figure 2A:
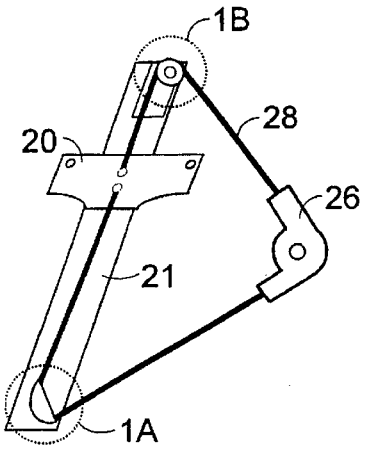
FIGS. 2(*a–c*), 3(*a–c*) and 4(*a–c*) are schematic views of alternative embodiments of portions of the regulator assembly shown in FIG. 1.
Figure 2B:
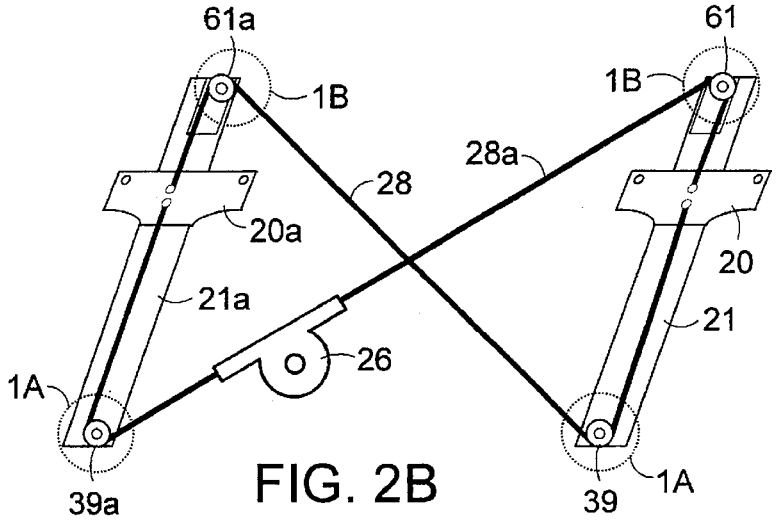
Figure 2C:
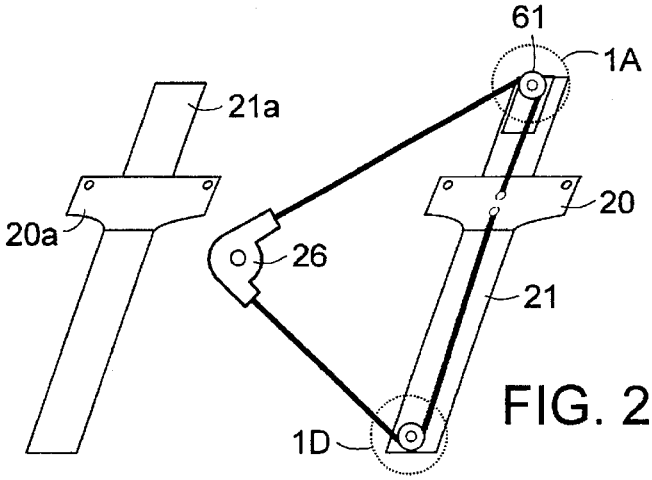

FIGS. 2(*a–c*), 3(*a–c*) and 4(*a–c*) show alternative embodiments which utilize the principles of the invention. FIG. 2(*a*) shows a simplified schematic view of the cable regulator assembly of FIG. 1, and FIGS. 2(*b*) and 2(*c*) show alternative arrangements which utilize the principles of the invention described above with reference to FIG. 1. FIG. 2(*b*) shows a dual-track cable regulator assembly which employs a first track 21 and a second track 21*a*. The dual tracks shown in FIG. 2(*b*) are preferable for use with large windows which require additional support. Gliders 20 and 20*a* are mounted on tracks 21 and 21*a* respectively. Cable 28 takes the form of two separate cables, 28*a* and 28*b* which are each coupled at a first end to glider 20 and at a second end to glider 20*a*. Cable 28*b* is wound in multiple wraps around a drum in drive assembly 26. Rotation of the drum in drive assembly 26 in a first direction causes cables 28*a* and 28*b* to move gliders 20 and 20*a* upward, and rotation of the drum in a second direction causes cables 28 and 28*a* to move gliders 20 and 20*a* downward. The dual-track cable regulator of FIG. 2(*b*) employs fixed rotatable pulleys 39 and 39*a* of the type seen in FIG. 1D at lower ends of tracks 21 and 21*a* and, slidable rotatable pulleys 61 and 61*a* of the type seen in FIG. 1A, at upper ends of tracks 21 and 21*a*. Slidable rotatable pulley 61 a reduces slack in cable 28 which occurs at the attachment of the cable to gliders 20 and 20*a*. Slidable rotatable pulley 61 performs a similar function, and also advantageously reduces slack in cable 28*a* caused by changes of direction of the drum in drive assembly 26. As seen in FIG. 2*b* pulleys 61 and 61*a* take a form as shown in greater detail in FIG. 1*a*. Pulleys 39 and 39*a* take a form as shown in greater detail in FIG. 1*b*.

FIG. 2(*c*) of the drawings shows a slave track window regulator assembly which employs a primary track 21 and a secondary track 21*a*. The slave track assembly shown in FIG. 2(*c*) offers greater support to a window than provided in the embodiment shown in FIG. 2(*a*), but at a lower cost than the assembly of FIG. 2(*b*). In FIG. 2(*c*), movement of cable 28 causes direct movement of glider 21 and indirect movement of glider 21*a*. The assembly of FIG. 2(*c*) employs a fixed rotatable pulley 39 at a lower end of track 21 and a slidable rotatable pulley 61 at a upper end of track 21. As seen in FIG. 2(*c*) pulley 61 takes a form as shown in greater detail in FIG. 1A, and pulley 39 takes a form as shown in greater detail in FIG. 1*d*.

Figure 3A:
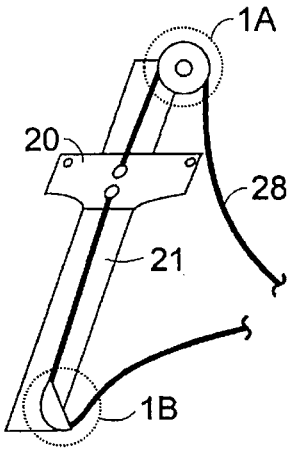
Figure 3B:
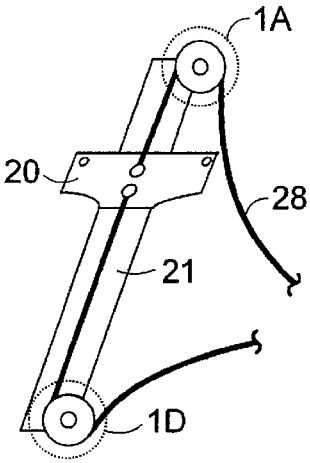
Figure 3C:
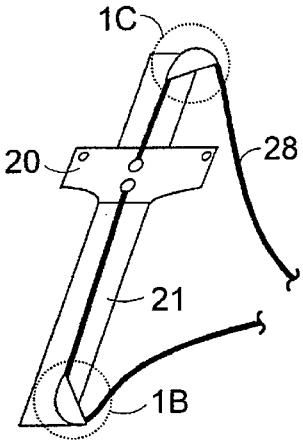

FIGS. 3(*a–c*) show alternative positions and combinations of guide means which may be employed in accordance with the principles of the invention. FIG. 3(*a*) shows a simplified schematic view of FIG. 1 in which the guide means used by the cable regulator assembly take the form of the guide means shown in FIGS. 2A and 1B at the upper and lower ends respectively of track 21. FIG. 3(*b*) shows a simplified schematic view of an alternative embodiment which employs a rotatable pulley at lower and upper ends of track 21. In FIG. 3(*c*), cable guides are utilized at both ends of the track. Each of the guide means shown in FIGS. 3(A–C) is shown in greater detail in FIGS. 1(A–D) as designated in the dotted circles in FIGS. 3(A–C).

Figure 4A:
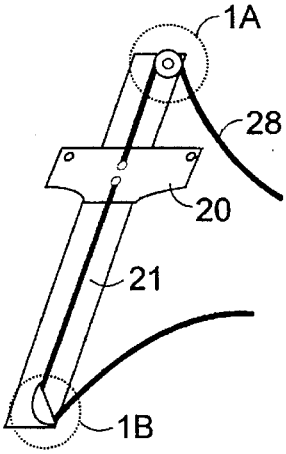
Figure 4B:
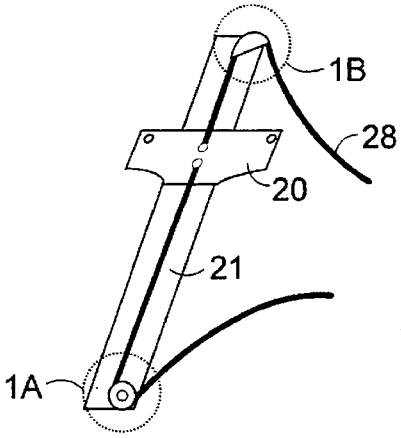
Figure 4C:
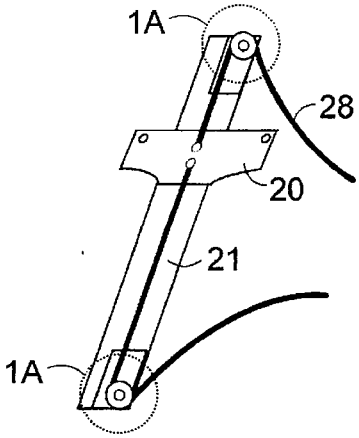

FIGS. 4(A–C) show alternative positions and combinations of the slidable rotatable pulley of FIG. 1A and the fixed cable guide of FIG. 1B. FIG. 4(A) shows the embodiment shown in FIG. 1, which employs a slidable rotatable pulley at an upper end of track 21 and a fixed cable guide at a lower end of track 21. In FIG. 4(*b*), the position of the pulley and cable guide in FIG. 4(A) is reversed with a fixed cable guide pulley at an upper end of track 21 and a slidable rotatable pulley at a lower end of track 21. FIG. 4(*c*) shows a window regulator assembly which employs slidable rotatable pulleys at each end of track 21.

In light of the foregoing disclosure of the invention and description of certain preferred embodiments, those who are skilled in this area of technology will readily understand that various modifications and adaptations can be made without departing from the true scope and spirit of the invention. For instance, the specific configuration of the slidable pulley shown in FIG. 1A may take a variety of forms. For example, the pulley plate 64 may be slidably mounted to track 21 in a number of different ways. In addition, spring 80 may take a number of different forms and may be captivated to the pulley plate 64 and track 21 in a number of different ways.

The relationship of the components shown in FIG. 1 may also be varied without departing from the true scope and spirit of the invention. For example, the position of subassembly 26 may be raised, lowered, or moved further away or closer to the pulleys 39 and 61. In addition, the shape of conduits 39 and 61 may be changed in order to change the path of travel of the cable. In addition, the fixed pulley 39 may take the form of slidable pulley 61. Additional pulleys or fixed cable guides may also be used to guide the cable. Further modifications and adaptations are also intended to be covered by the following claims.

What is claimed is:

1. A window regulator assembly comprising, in combination:

a first glider attached to a windowpane and slidably mounted to an elongated first track;

a cable attached to said first glider;

a first cable guide means attached to a first position on said first track;

a second cable guide means slidably coupled to a second position on said first track, said cable traveling along a first axis between said first cable guide means and said second cable guide means to move said glider along said first track, said second cable guide means having a centerline of travel in a direction along said first track;

rotatable cable drive means for moving said cable along said first axis upon rotation of said cable drive means; and a first spring positioned substantially along said centerline of travel and coupled at a first position on said first spring to said second cable guide, and at a second position on said first spring to said first track, said first spring exerting a force on said second cable guide means substantially along said centerline of travel to force said second cable guide means in a direction along said first track, away from said first cable guide means.

2. A window regulator as set forth in claim 1 wherein said second cable guide means is a pulley.

3. A window regulator as set forth in claim 2 wherein said second cable guide means includes a pulley plate slidably coupled to said first track and wherein said pulley of said second cable guide means is rotatably coupled to said pulley plate.

4. A window regulator as set forth in claim 3 further comprising:

a first cable guide conduit enclosing said cable between said first cable guide and said cable drive means; and a second cable guide conduit enclosing said cable between said second cable guide and said cable drive means.

5. A window regulator as set forth in claim 4 wherein said first cable guide means is a pulley.

6. A window regulator as set forth in claim 5 wherein said first cable guide means includes a pulley plate mounted to said first track and wherein said pulley of said first cable guide means is rotatably coupled to said pulley plate of said first cable guide means.

7. A window regulator as set forth in claim 1 further comprising:

a second glider attached to said windowpane and slidably mounted to an elongated second track positioned substantially parallel to said first track, said cable being attached to said glider;

a third cable guide means attached to a first position on said second track;

a fourth cable guide means slidably coupled to a second position on said second track, said cable traveling along a second axis, substantially parallel to said first axis, between said third cable guide means and said fourth cable guide means to move said second glider along said second track, said rotatable cable drive means moving said cable along said first axis and said second axis upon rotation of said cable drive means, said fourth cable guide means having a centerline of travel in a direction along said second track; and a second spring positioned substantially along said centerline of travel and coupled at a first position on said spring to said fourth cable guide means, and at a second position on said spring to said second track, said spring exerting a force on said fourth cable guide means substantially along said centerline of travel to force said fourth cable guide means in a direction along said second track, away from said third cable guide means.

8. A window regulator as set forth in claim 7 wherein said second and fourth cable guide means are pulleys.

9. A window regulator as set forth in claim 8 wherein said first and third cable guide means are pulleys.

10. A window regulator as set forth in claim 1 further comprising a second glider attached to said windowpane and slidably mounted to an elongated second track positioned substantially parallel to said first track.

11. A window regulator as set forth in claim 10 wherein said second cable guide means is a pulley.

12. A window regulator as set forth in claim 11 wherein said first cable guide means is a pulley.

13. A window regulator comprising:

a cable, attached at a first end and at a second end to a glider which is attached to a vehicle window;

a first plate attached to a first position on an elongated first track;

a first guide means attached to said first plate;

a second plate slidably coupled to a second position on said first track;

a first pulley, rotatably coupled to said second plate, whereby said cable travels along a first axis extending between said first guide means and said first pulley and passes around an outer portion of said first guide means and said first pulley, said second plate having a centerline of travel in a direction along said first track;

a cable drum for causing movement of said cable;

a spring positioned substantially along said centerline of travel and coupled at a first position on said spring to said second plate, and at a second position on said spring to said first track, said spring exerting a force on said second plate substantially along said centerline of travel to force said second plate in a direction along said first track, away from said first pulley plate.

14. A window regulator as set forth in claim 13 wherein the second plate is slidably mounted to said first track by means of a pair of tabs, each of said tabs extending through a corresponding elongated channel in said second plate, each of said tabs being positioned to captivate said second plate.

15. A window regulator as set forth in claim 14 wherein said spring is coupled at said first position on said spring to a protruding portion of said second plate and at said second position on said spring to a protruding portion of said first track.

16. A window regulator as set forth in claim 15 wherein said first plate has formed thereon a lip around a first end, said lip shaped to be substantially concentric with said outer portion of said first guide means.

17. A window regulator as set forth in claim 16 wherein said second plate has formed thereon a lip around a first end, said lip shaped to be substantially concentric with said outer portion of said first pulley.

18. A window regulator as set forth in claim 17 further comprising:

a second glider attached to said window and slidably mounted to an elongated second track positioned substantially parallel to said first track, said cable being attached to said second glider;

a third plate attached to a first position on said second track;

a second cable guide means attached to said third plate;

a fourth plate slidably coupled to a second position on said second track;

a second pulley rotatably coupled to said fourth plate, said cable traveling along a second axis, substantially parallel to said first axis, between said second cable guide means and said second pulley, said fourth plate having a centerline of travel in a direction along said second track, to move said second glider along said second track, said cable drum operable to cause movement of said cable along said first axis and said second axis; and a second spring positioned substantially along said centerline of travel and coupled at a first position on said second spring to said fourth plate, and at a second position on said second spring to said second track, said spring exerting a force on said fourth plate substantially along said centerline of travel to force said fourth plate in a direction along said second track, away from said second cable guide means.

19. A window regulator as set forth in claim 17 further comprising a second glider attached to said window and slidably mounted to an elongated second track positioned substantially parallel to said first track.

20. A window regulator assembly comprising, in combination:

a first glider attached to a windowpane and slidably mounted to an elongated first track;

a cable attached to said first glider;

a first cable guide attached to a first position on said first track;

a second cable guide slidably coupled to a second position on said first track, said glider being moved along said first track by movement of said cable along a first axis between said first cable guide and said second cable guide, said second cable guide having a centerline of travel in a direction along said first track;

cable drive means for causing movement of said cable along said first axis; and a first spring coupled to exert a force on said second cable guide substantially along said centerline of travel to force said second cable guide in a direction along said first track, away from said first cable guide.

21. A window regulator assembly as set forth in claim 20 wherein the force exerted by said first spring is a continuous force which maintains a substantially continuous tension on said cable.

22. A window regulator assembly as set forth in claim 1 wherein the force exerted by said first spring is a continuous force which maintains a substantially continuous tension on said cable.

23. A window regulator assembly as set forth in claim 6 wherein the force exerted by said first spring is a continuous force which maintains a substantially continuous tension on said cable.

24. A window regulator assembly as set forth in claim 9 wherein the force exerted by said first spring is a continuous force which maintains a substantially continuous tension on said cable.

25. A window regulator assembly as set forth in claim 12 wherein the force exerted by said first spring is a continuous force which maintains a substantially continuous tension on said cable.

26. A window regulator assembly as set forth in claim 13 wherein the force exerted by said spring is a continuous force which maintains a substantially continuous tension on said cable.

27. A window regulator assembly as set forth in claim 18 wherein the force exerted by said second spring is a continuous force which maintains a substantially continuous tension on said cable.

28. A window regulator assembly as set forth in claim 19 wherein the force exerted by said spring is a continuous force which maintains a substantially continuous tension on said cable.

* * * * *